US008763209B2

(12) United States Patent
Kavarsky et al.

(10) Patent No.: US 8,763,209 B2
(45) Date of Patent: Jul. 1, 2014

(54) RATCHET BUCKLE AND STRAP ASSEMBLY

(75) Inventors: Raymond Kavarsky, Waterbury, VT (US); Christopher M. Doyle, Waterbury, VT (US)

(73) Assignee: The Burton Corporation, Burlington, VT (US)

( * ) Notice: Subject to any disclaimer, the term of this patent is extended or adjusted under 35 U.S.C. 154(b) by 475 days.

(21) Appl. No.: 13/215,589

(22) Filed: Aug. 23, 2011

(65) Prior Publication Data

US 2013/0047388 A1 Feb. 28, 2013

(51) Int. Cl.

| | |
|---|---|
| ***A43C 11/14*** | (2006.01) |
| ***A63C 9/00*** | (2012.01) |
| ***A44B 11/12*** | (2006.01) |
| ***A63C 10/06*** | (2012.01) |
| *A63C 10/24* | (2012.01) |

(52) U.S. Cl.

CPC ..... *A43C 11/1413* (2013.01); *A43C 11/142* (2013.01); *A43C 11/146* (2013.01); *A63C 10/06* (2013.01); *A63C 10/24* (2013.01)

USPC ..... 24/68 SK; 24/70 SK

(58) Field of Classification Search

CPC ..... A43C 11/1413; A43C 11/142; A43C 11/146; A63C 10/06; A63C 10/24

USPC ..... 24/68 E, 68 SK, 70 SK

See application file for complete search history.

(56) References Cited

U.S. PATENT DOCUMENTS

| | | | |
|---|---|---|---|
| 357,287 | A | 2/1887 | Nolte |
| 376,055 | A | 1/1888 | Hopkins et al. |
| 3,009,220 | A | 11/1961 | Fein |
| 3,662,435 | A | 5/1972 | Allsop |
| 3,735,449 | A | 5/1973 | Rosales |

(Continued)

FOREIGN PATENT DOCUMENTS

| | | | |
|---|---|---|---|
| BE | 518012 | 3/1953 | |
| EP | 0771536 A1 * | 5/1997 | ..... A43C 11/14 |

(Continued)

OTHER PUBLICATIONS

Invitation to Pay Additional Fees from the International Searching Authority for International Application No. PCT/US2012/051810, Mailed Nov. 16, 2012.

*Primary Examiner* — Robert J Sandy

(74) *Attorney, Agent, or Firm* — Wolf, Greenfield & Sacks, P.C.

(57) ABSTRACT

A ratchet buckle and strap assembly is provided. The ratchet buckle has a passageway configured to slidably receive the strap, a pawl arranged to engage the strap and prevent movement of the strap in a direction from the rear portion toward the front portion, while allowing movement of the strap in a direction from the front portion toward the rear portion of the passageway, and a drive actuator arranged to engage the strap and feed the strap through the passageway from the front portion toward the rear portion of the passageway. The strap may have a plurality of first teeth, and a plurality of separate second teeth. The first teeth may be on a first side of the strap and the second teeth may be on a second side of the strap. The ratchet buckle may be configured such that the pawl is configured to engage a first side of the strap and the drive actuator may be configured to engage a second side of the strap opposite the first side.

47 Claims, 14 Drawing Sheets

(56) References Cited

U.S. PATENT DOCUMENTS

| | | | | |
|---|---|---|---|---|
| 3,747,164 | A | 7/1973 | Fortsch | |
| 4,326,320 | A | 4/1982 | Riedel | |
| 4,395,801 | A | 8/1983 | Gabrielli | |
| 4,646,401 | A | 3/1987 | Morell | |
| 4,660,302 | A * | 4/1987 | Arieh et al. | 24/68 SK |
| 4,735,387 | A | 4/1988 | Hirano et al. | |
| 4,807,325 | A | 2/1989 | Kuhbauch | |
| 5,416,952 | A | 5/1995 | Dodge | |
| 5,526,555 | A | 6/1996 | Battistella et al. | |
| RE35,418 | E | 1/1997 | Martignago | |
| 5,606,779 | A | 3/1997 | Lu | |
| 5,642,555 | A | 7/1997 | Lin | |
| 5,745,959 | A | 5/1998 | Dodge | |
| 5,745,963 | A | 5/1998 | Graziano | |
| 5,779,259 | A | 7/1998 | Lin | |
| 5,852,852 | A | 12/1998 | Rigal | |
| 5,887,318 | A | 3/1999 | Nicoletti | |
| 6,163,941 | A | 12/2000 | Lai | |
| 6,175,994 | B1 | 1/2001 | Nicoletti | |
| 6,185,792 | B1 | 2/2001 | Nelson et al. | |
| 6,206,403 | B1 | 3/2001 | Black et al. | |
| 6,374,464 | B1 | 4/2002 | Lai | |
| 6,390,492 | B1 | 5/2002 | Bumgarner et al. | |
| 6,405,457 | B1 | 6/2002 | Basso et al. | |
| 6,481,070 | B2 | 11/2002 | Caeran et al. | |
| 6,536,138 | B1 | 3/2003 | Miralles | |
| 6,604,746 | B1 | 8/2003 | Sato et al. | |
| 6,609,276 | B1 | 8/2003 | Lin | |
| 6,669,211 | B2 | 12/2003 | Gonthier | |
| 6,694,644 | B2 | 2/2004 | Haupt | |
| 6,729,047 | B2 | 5/2004 | Hirayama | |
| 6,748,630 | B2 | 6/2004 | Livingston | |
| 6,773,020 | B2 | 8/2004 | Gonthier | |
| 6,859,981 | B2 | 3/2005 | Hsiao | |
| 6,898,826 | B2 | 5/2005 | Draper et al. | |
| 6,974,149 | B2 | 12/2005 | Naito et al. | |
| 7,011,333 | B2 | 3/2006 | Pascal | |
| 7,036,830 | B2 | 5/2006 | Gonthier | |
| 7,086,122 | B2 | 8/2006 | Livingston | |
| 7,232,147 | B2 | 6/2007 | Couderc | |
| 7,278,651 | B2 | 10/2007 | Naito et al. | |
| 7,316,412 | B2 | 1/2008 | Couderc | |
| 7,374,194 | B2 | 5/2008 | Naito et al. | |
| 7,427,079 | B2 | 9/2008 | Piva | |
| 7,568,719 | B2 | 8/2009 | Sauter | |
| 7,802,808 | B2 | 9/2010 | Neiley | |
| 2001/0013157 | A1 | 8/2001 | Giancarlo | |
| 2002/0000707 | A1 | 1/2002 | Couderc | |
| 2003/0005556 | A1 | 1/2003 | Gallina | |
| 2003/0019081 | A1 * | 1/2003 | Livingston | 24/68 R |
| 2003/0098569 | A1 | 5/2003 | Gonthier | |
| 2003/0127832 | A1 | 7/2003 | Couderc et al. | |
| 2004/0145128 | A1 | 7/2004 | Couderc | |
| 2004/0211039 | A1 * | 10/2004 | Livingston | 24/68 SK |
| 2005/0198787 | A1 | 9/2005 | Lee | |
| 2007/0175067 | A1 | 8/2007 | Pascal et al. | |
| 2008/0054600 | A1 | 3/2008 | Caslowitz | |
| 2008/0150259 | A1 | 6/2008 | Veyrat-Charvillon | |
| 2008/0189922 | A1 | 8/2008 | Marechal et al. | |
| 2009/0111078 | A1 | 4/2009 | Rancon | |
| 2009/0134602 | A1 | 5/2009 | Pontano et al. | |
| 2010/0162539 | A1 | 7/2010 | Rancon | |
| 2010/0176576 | A1 | 7/2010 | Lanez et al. | |

FOREIGN PATENT DOCUMENTS

| | | | | |
|---|---|---|---|---|
| EP | 1386554 | A1 | 2/2004 | |
| EP | 1386554 | B1 | 11/2004 | |
| EP | 1611811 | A1 * | 1/2006 | A43C 11/14 |
| GB | 1383912 | | 2/1975 | |

* cited by examiner

RATCHET BUCKLE AND STRAP ASSEMBLY

FIELD

The present invention is directed to a ratchet buckle and strap assembly, and more particularly, to a ratchet buckle and strap assembly which may be incorporated into a foot or boot binding system, such as a snowboard boot binding.

BACKGROUND

Ratchet buckles are used in a variety of applications and, for instance, are known for securing and releasing snowboard binding straps. For example, U.S. Pat. Nos. 5,416,952 and 5,745,959 (both assigned to The Burton Corporation) are directed to ratchet buckles which are used in snowboard boot bindings and permit incremental tightening of the binding straps as well as quick release of the buckle and straps. The '959 patent discloses a buckle which is configured to receive a strap. The buckle has a drive actuator for tightening the strap and a pawl for locking the strap. The drive actuator and the pawl engage with teeth located on one side of the strap.

SUMMARY

In one illustrative embodiment, a ratchet buckle and strap assembly is provided which includes a strap and a ratchet buckle. The ratchet buckle includes a passageway configured to slidably receive the strap, the passageway having a front portion and a rear portion, a pawl constructed and arranged to engage the strap and prevent movement of the strap in a direction from the rear portion toward the front portion, while allowing movement of the strap in a direction from the front portion toward the rear portion of the passageway, and a drive actuator constructed and arranged to engage the strap and feed the strap through the passageway from the front portion toward the rear portion of the passageway. The strap has a plurality of first teeth configured to coact with the pawl, and a plurality of separate second teeth configured to coact with the drive actuator.

In another illustrative embodiment, a ratchet buckle and strap assembly is provided which includes a strap and a ratchet buckle. The ratchet buckle includes a passageway configured to slidably receive the strap, the passageway having a front portion and a rear portion, a pawl constructed and arranged to engage a first side of the strap and prevent movement of the strap in a direction from the rear portion toward the front portion, while allowing movement of the strap in a direction from the front portion toward the rear portion of the passageway, and a drive actuator constructed and arranged to engage a second side of the strap opposite the first side and feed the strap through the passageway from the front portion toward the rear portion of the passageway.

In yet another illustrative embodiment, a ratchet buckle and strap assembly is provided which includes a strap and a ratchet buckle. The ratchet buckle includes a passageway configured to slidably receive the strap, the passageway having a front portion and a rear portion, a pawl constructed and arranged to engage a first side of the strap and prevent movement of the strap in a direction from the rear portion toward the front portion, while allowing movement of the strap in a direction from the front portion toward the rear portion of the passageway, and a release actuator constructed and arranged to be actuated to disengage the pawl from the first side of the strap. The pawl is pivotable about a pawl axis, and the release actuator is pivotable about a release actuator axis. The pawl axis is located below the passageway and the release actuator axis is located above the passageway.

Various embodiments of the present invention provide certain advantages. Not all embodiments of the invention share the same advantages and those that do may not share them under all circumstances.

Further features and advantages of the present invention, as well as the structure of various embodiments that incorporate aspects of the invention are described in detail below with reference to the accompanying drawings.

BRIEF DESCRIPTION OF DRAWINGS

The foregoing and other objects and advantages of the invention will be appreciated more fully from the following drawings, wherein like reference characters designate like features, in which.

DETAILED DESCRIPTION OF INVENTION

Applicant recognized that prior ratchet buckles with a toothed strap have teeth on only one side of the strap. Thus, prior ratchet buckles having both a drive actuator to tighten the strap and a pawl to lock the strap are configured such that both the drive actuator and the pawl interact with the same side of the strap. The drive actuator and the pawl thus engage the same set of teeth on the strap.

As set forth in greater detail below, one aspect of the present invention is directed to a ratchet buckle and strap assembly where the ratchet assembly includes a pawl that is arranged to coact with a plurality of first teeth on the strap, and a drive actuator that is arranged to coact with a plurality of separate second teeth on the strap. As set forth below, such a configuration may help to prolong the life of the strap. The plurality of first teeth may be on a first side of the strap and the plurality of second teeth may be on a second side of the strap, opposite the first side. It is contemplated that having teeth on both sides of the strap may enable the pawl to be positioned closer to the forward end of the strap passageway which may reduce the amount that the strap must be inserted into the buckle before the pawl contacts the strap.

Applicant further recognized that in prior ratchet buckles, the teeth on the strap are generally oriented in a direction that is substantially perpendicular to a longitudinal axis of the strap.

As set forth below, another aspect of the present invention is directed to a ratchet buckle and strap assembly where the strap has a plurality of first teeth and a plurality of second teeth, where the orientation of the first teeth is different from the orientation of the second teeth. As discussed below, this may help to promote engagement of the ratchet buckle components with the strap teeth.

Figure 1:
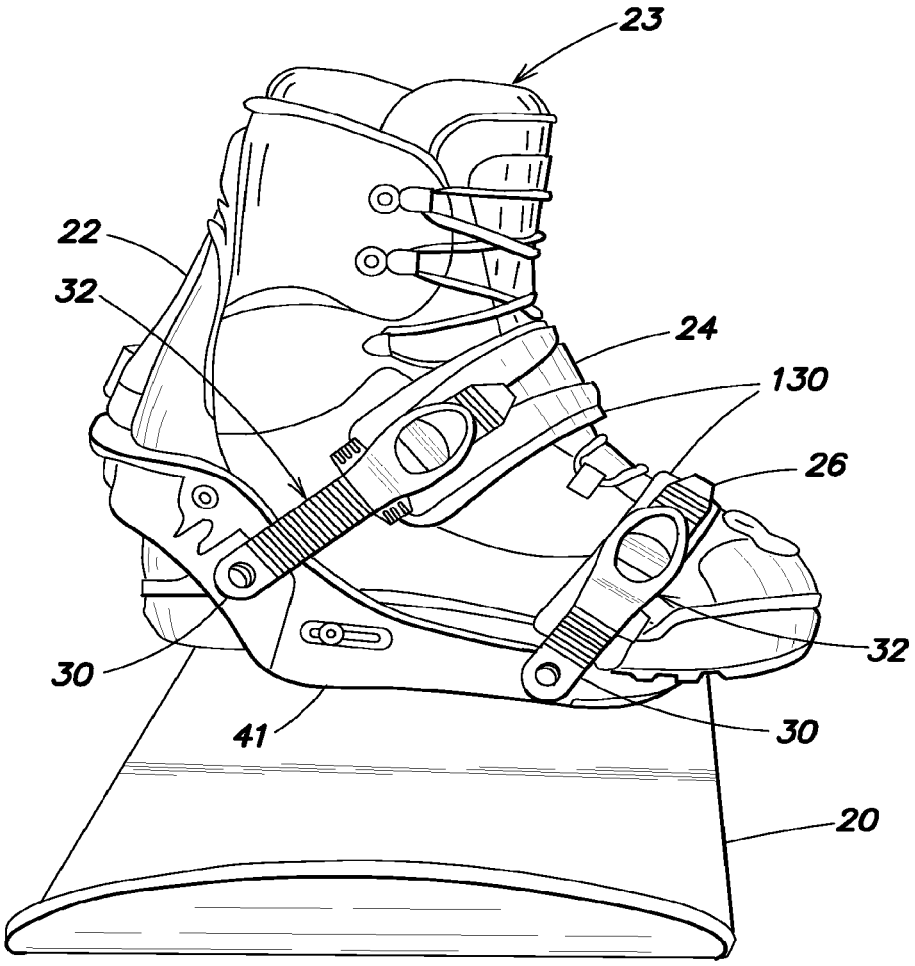
FIG. 1 is a representative perspective view of a snowboard that includes a snowboard binding with a ratchet buckle mounted on the snowboard binding.
Figure 2:
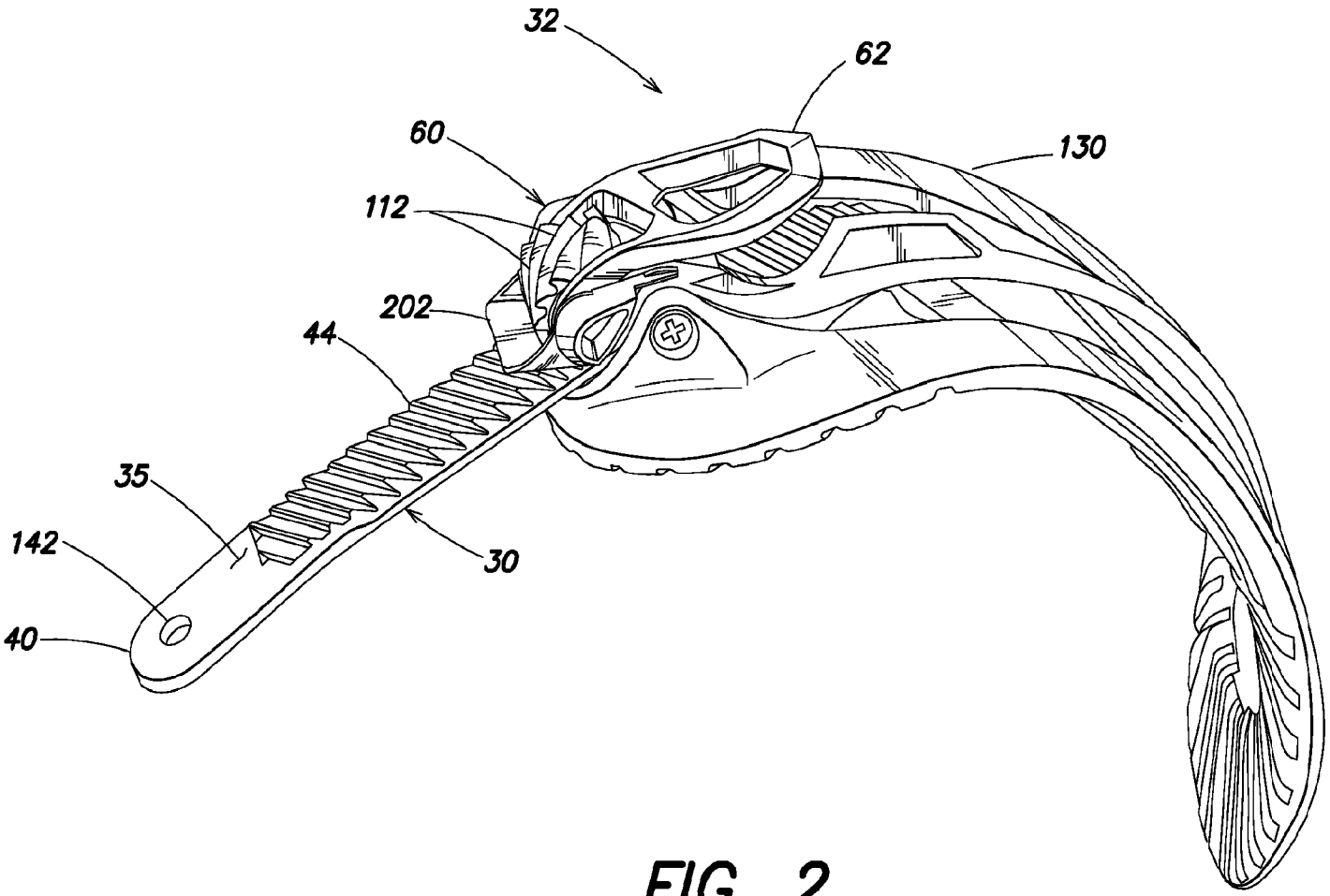
FIG. 2 is a perspective view of a ratchet buckle and strap assembly according to one embodiment.

As shown in FIG. 1, a ratchet buckle 32 and strap 30 may be used on a snowboard boot binding 22 to attach a snowboard boot 23 to a snowboard 20. The binding 22 may include at least one adjustable strap, and typically two or three, which may be tightened across various portions of the foot. For example, as shown in FIG. 1, the adjustable straps may include an ankle strap 24 and a toe strap 26, and, and may further include a shin strap (not shown). These straps may be mounted to a binding base plate 41 using a fastener, such as a screw, rivet, or the like, and the straps may be incrementally tightened and conveniently released using the ratchet buckle 32. As shown, a first ratchet buckle 32 is attached to a portion 130 of the ankle strap 24 and a second ratchet buckle 32 is attached to a portion 130 of the toe strap 26.

Furthermore, as set forth below, it is also contemplated that the below-described ratchet buckle and strap assembly may be used in other non-snowboarding applications, such as, but not limited to, other foot or boot binding systems, including snow skiing and water skiing. It is also contemplated that the ratchet buckle and strap assembly may be used in various types of footwear.

Turning now to FIGS. 2-12, one embodiment of a ratchet buckle 32 and strap 30 assembly is illustrated. The ratchet buckle 32 is adapted to slidably receive and secure the strap 30. The strap 30 may be one portion of an adjustable strap, such as ankle strap 24 or toe strap 26 shown in FIG. 1, and the ratchet buckle 32 may be coupled to another portion 130 of the strap 24, 26. As set forth in greater detail below, a first side 33 of the strap 30 has a plurality of first teeth 34 (see FIGS. 6, 7 and 10), and a second side 35 of the strap 30 has a plurality of second teeth 44 (see FIGS. 2-5, 7 and 8). One end of the strap 30 may include a rounded or tapered tip 38 that is inserted into the buckle 32 and an opposite end 40 of the strap may include a hole 142 configured for mounting the strap 30 to a binding base plate 41 (see FIG. 1) using a fastener, such as a screw, rivet or the like, as is known in the art.

As discussed in greater detail below, the ratchet buckle 32 may be coupled to a strap portion 130 of the adjustable strap. The strap 30 may be mounted to a first side of the binding base plate 41, and the strap portion 130 may be mounted to a second opposite side of the binding base plate 41 such that collectively, the strap 30, buckle 32 and strap portion 130 help to retain the boot 23 to the snowboard 20. It is also contemplated that in another embodiment, the buckle 32 may be coupled directly to the binding base plate 41 and the strap portion 130 may be omitted.

Figure 3:
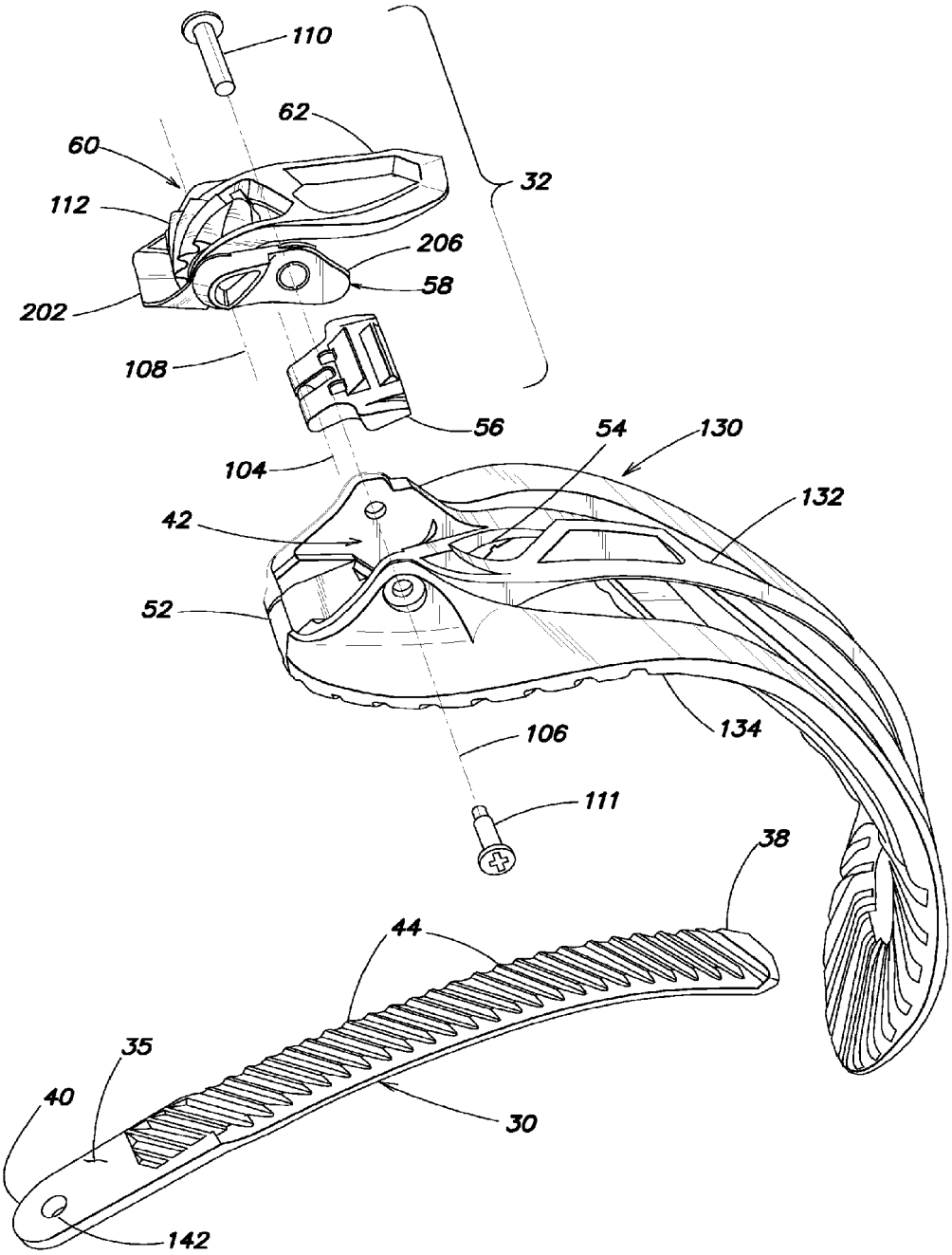
FIG. 3 is a partially exploded perspective view of the ratchet buckle and strap assembly shown in FIG. 2.
Figure 13:
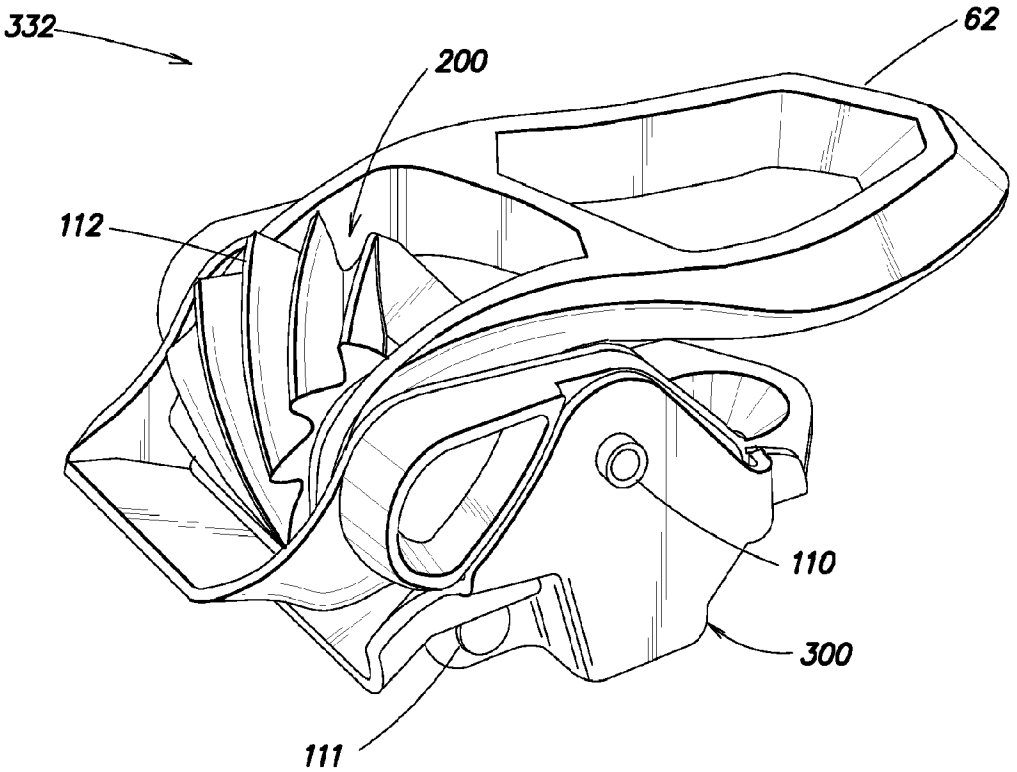
FIG. 13 is a perspective view a ratchet buckle according to another embodiment.
Figure 14:
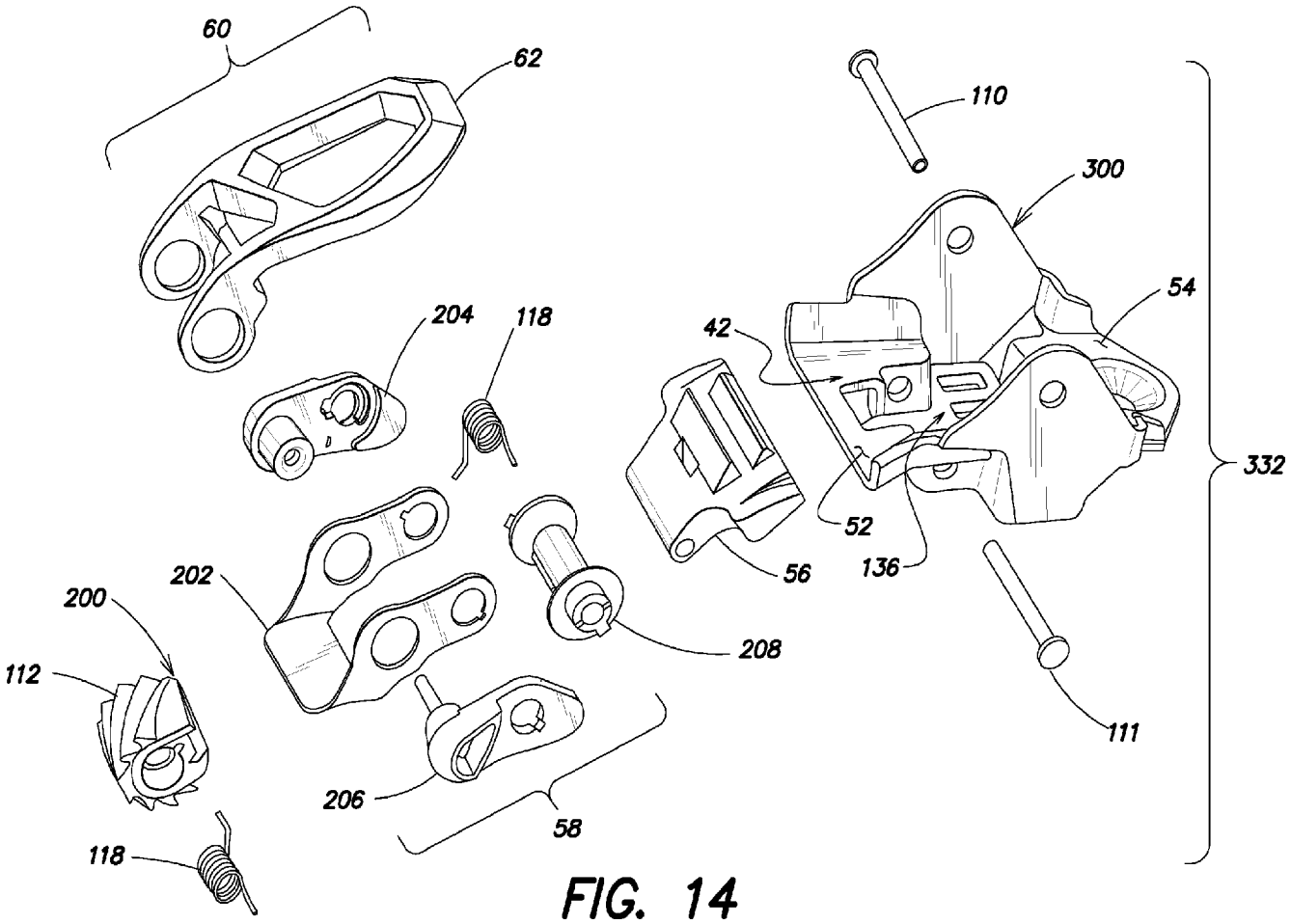
FIG. 14 is an exploded perspective view of the ratchet buckle shown in FIG. 13.

The ratchet buckle 32 has a passageway 42 for slidably receiving the strap 30. As shown in FIG. 3, in one illustrative embodiment, the passageway 42 is defined by the strap portion 130. In this respect, the strap portion acts as a buckle body. However, as discussed in greater detail below, in another embodiment shown in FIGS. 13 and 14, the ratchet buckle 32 may include a separate body or housing (separate from the strap portion 130) which defines the passageway 42, as the invention is not limited in this respect. The strap 30 is inserted into the front portion 52 of the passageway 42 and exits through the rear portion 54 of the passageway. The ratchet buckle 32 includes a pawl 56, which as discussed in greater detail below, engages the strap and prevents the strap from backing out of the passageway, and when desired, allows a user to easily loosen or completely release the strap 30. The ratchet buckle 32 also includes a drive actuator 60 which allows the user to incrementally drive the strap 30 through the buckle 32 to selectively tighten the strap 30.

Figure 4:
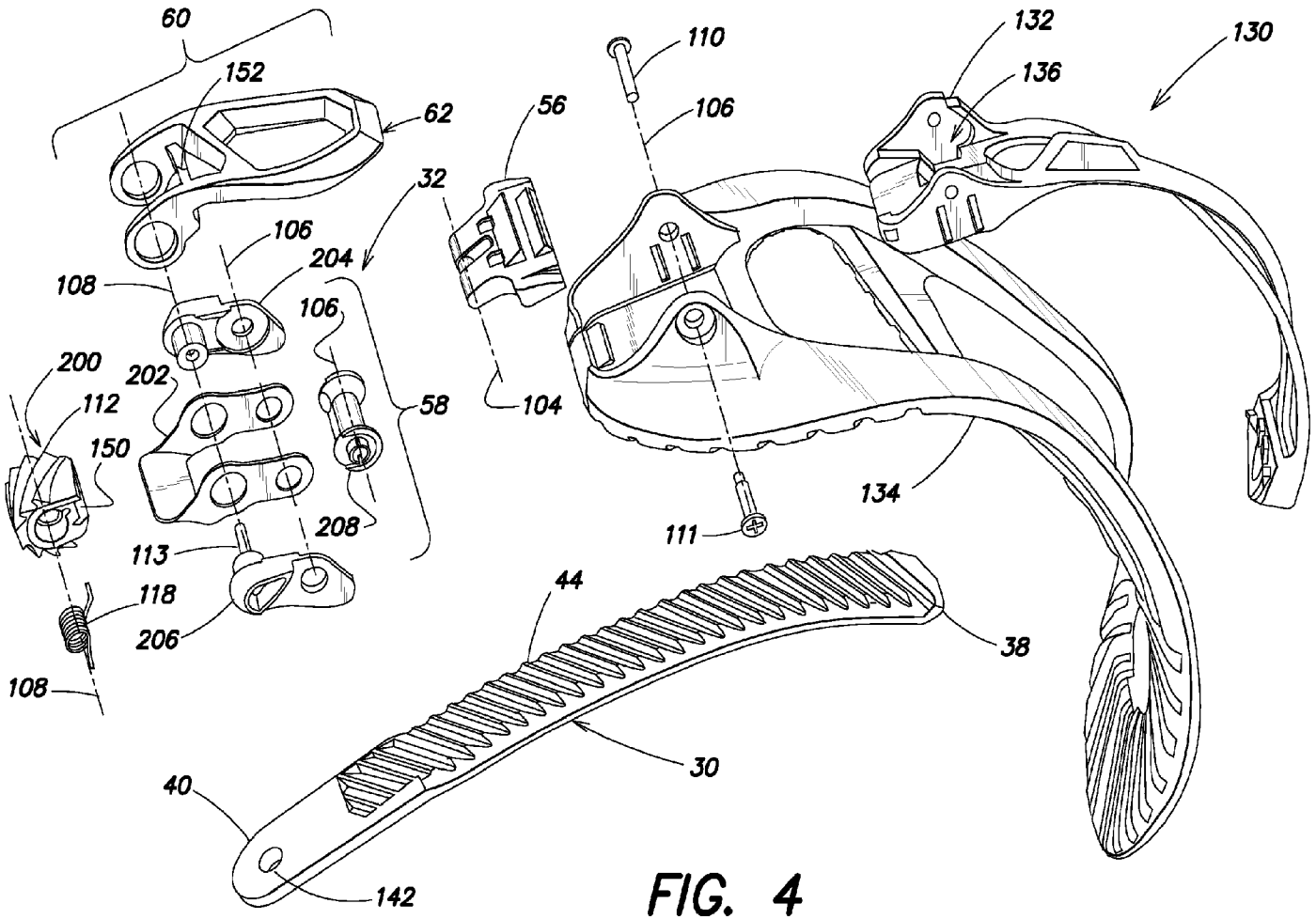
FIG. 4 is an exploded view of the ratchet buckle and strap assembly shown in FIG. 2.
Figure 7:
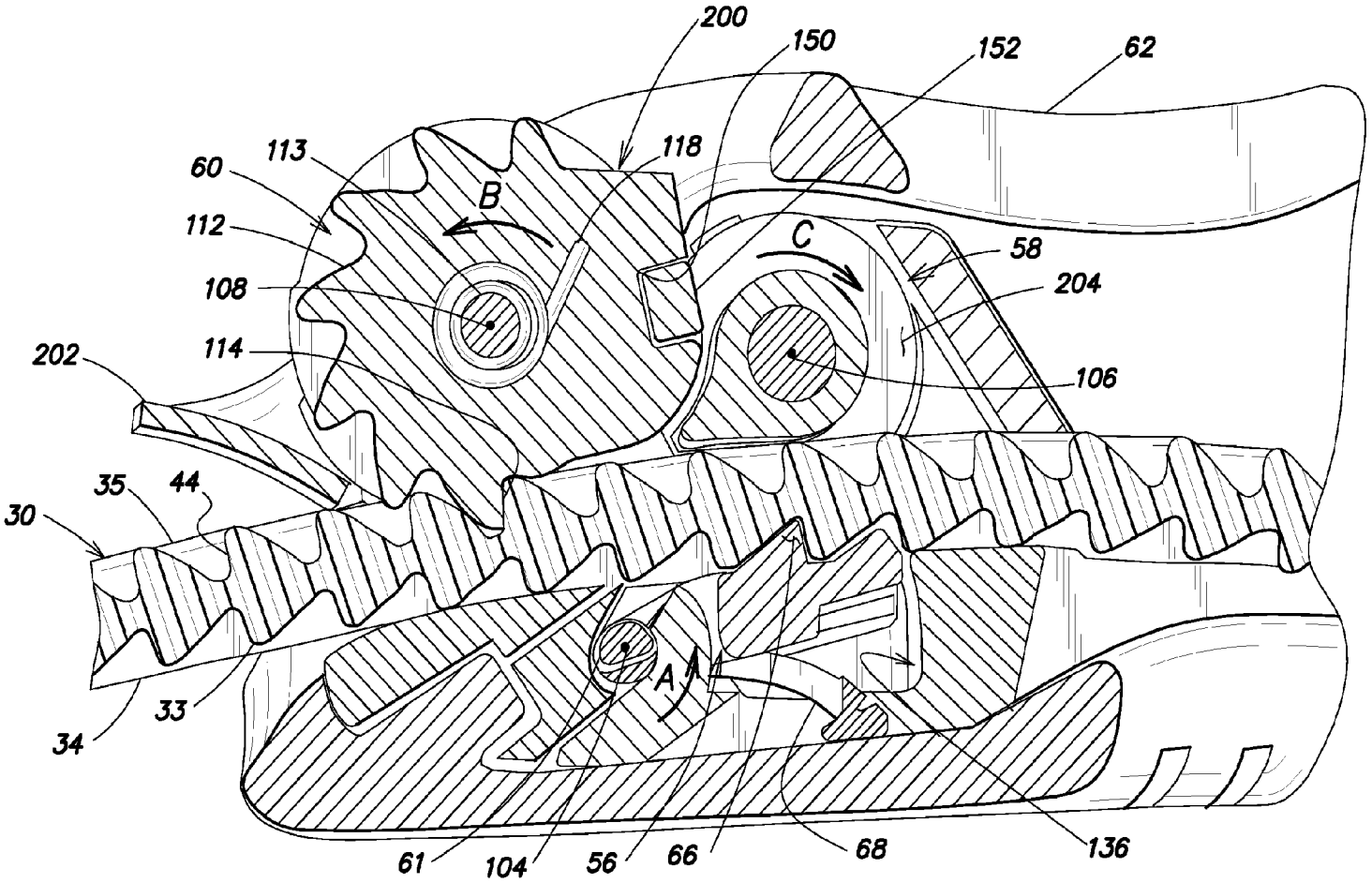
FIG. 7 is a cross-sectional view of the ratchet buckle and strap assembly shown in FIG. 2 taken along line 7-7 shown in FIG. 5.
Figure 11:
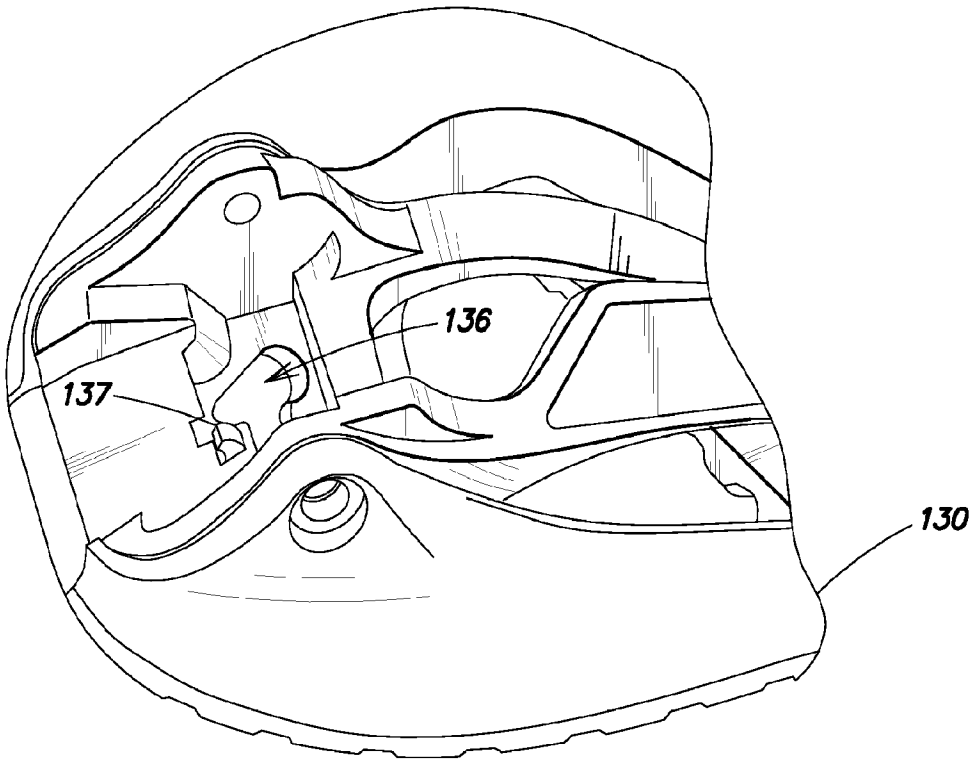
FIG. 11 is a partially exploded top perspective view of the pawl and the strap portion.
Figure 11:
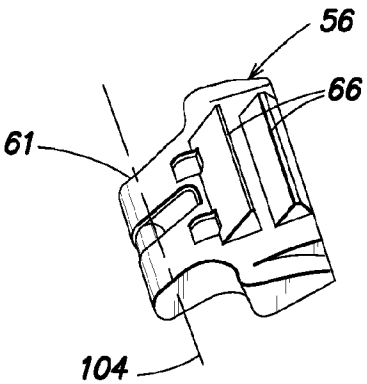

The pawl 56 may be arranged to engage the first side 33 of the strap 30 and retain the strap 30 so that the strap cannot be released until the user disengages the pawl 56 from the strap. As shown in FIGS. 4 and 11, in one embodiment, the pawl 56 is positioned within a cavity 136 formed in the strap portion 130. As shown in FIG. 7, the pawl 56 may be positioned below the passageway 42 for the strap 30 such that the pawl can engage with the first side 33 of the strap 30, which as illustrated, may be on the underside of the strap. As shown in FIGS. 7 and 11, the pawl 56 may be pivotally mounted to the strap portion 130 (i.e. buckle body) about pivot 61 which defines a pivot axis 104. In particular, as shown in FIG. 11, the cavity 136 may include a hook 137 with a cylindrical surface that is configured to engage with the shape of the pivot 61 on the pawl 56 to prevent the pawl 56 from exiting the cavity 136. In another embodiment, the pawl may be coupled to the strap portion 130 differently, such as with rivets, as the invention is not so limited.

Figure 9:
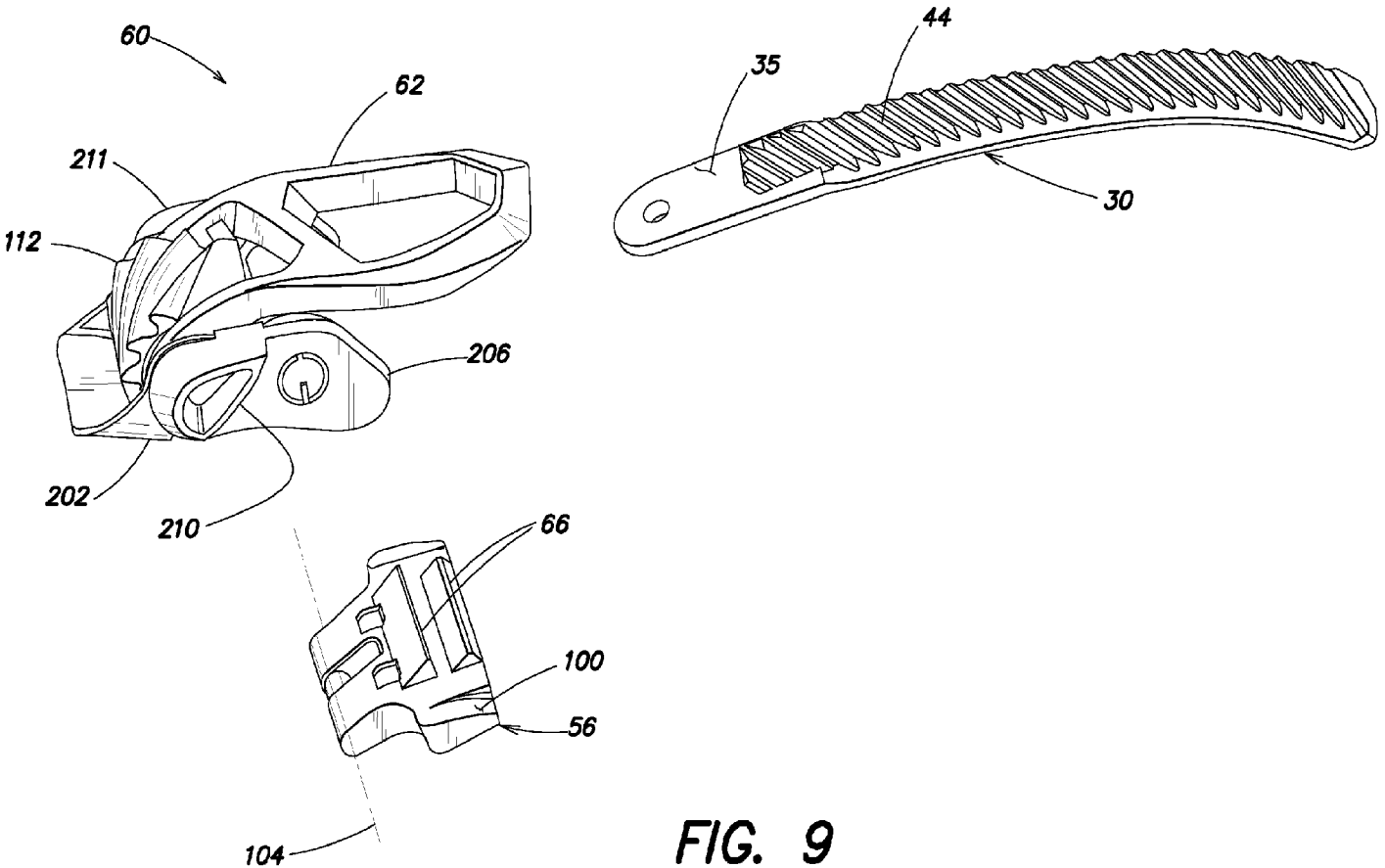
FIG. 9 is a partially exploded top perspective view of the ratchet buckle and strap assembly shown in FIG. 2 with portions removed.
Figure 10:
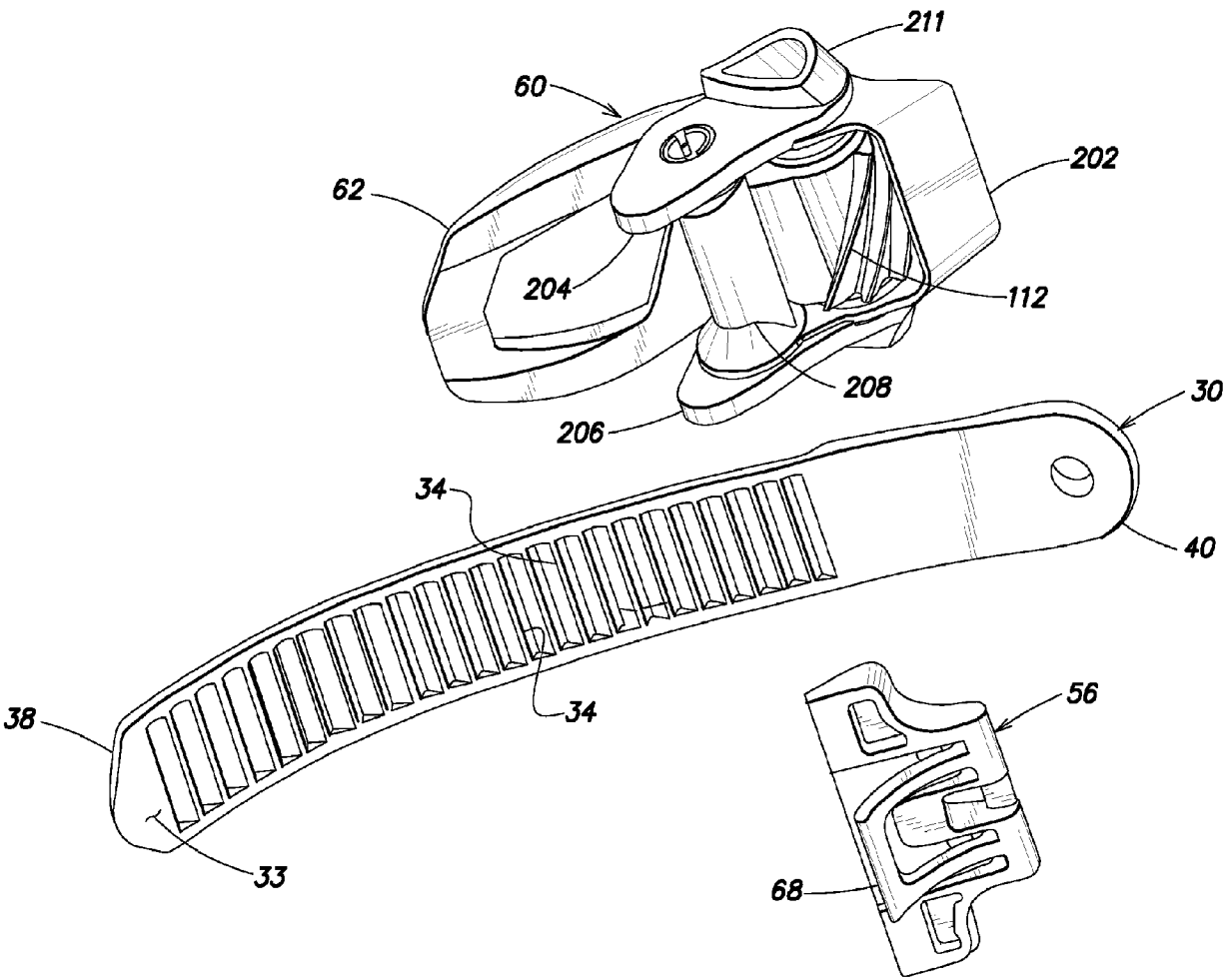
FIG. 10 is a partially exploded bottom perspective view of the ratchet buckle and strap assembly shown in FIG. 2 with portions removed.

The pawl 56 may include one or more pawl teeth 66 configured to engage with the strap teeth 34 on the first side 33 of the strap so that the strap 30 can be tightened in one direction and cannot be loosened or released in the opposite direction until the pawl 56 is released from the strap by the user. As shown in FIGS. 7, 9 and 11, in one embodiment, the pawl 56 has two teeth.

Figure 12:
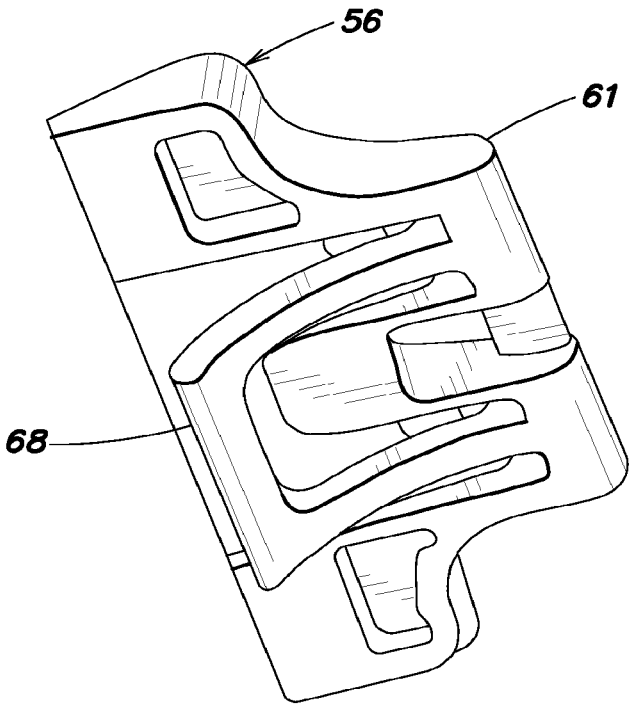
FIG. 12 is a perspective view of the underside of the pawl.

As shown in FIG. 7, the pawl 56 is biased in the direction of arrow A (counterclockwise in FIG. 7) and into engagement with the strap 30 to ensure that the pawl does not inadvertently disengage from the strap. In one embodiment, the pawl includes a living hinge 68 configured to maintain the pawl 56 securely against the strap 30. In particular, as shown in FIG. 12, a substantially U-shaped living hinge 68 extends out from the underside of the pawl 56. As shown in FIG. 7, the living hinge 68 presses against a bottom surface of the cavity 136 to bias the pawl teeth 66 into engagement with the strap 30. As the strap 30 is fed through the buckle 32 and tightened, the pawl 56 pivots in a reciprocating manner so that it intermittently engages and disengages the strap teeth 34. One of ordinary skill in the art would appreciate that the pawl 56 may be biased differently, such as with a leaf spring, a coil spring, a compression spring etc., as the invention is not so limited.

The drive actuator 60 is used to incrementally tighten the strap 30 by driving or feeding the strap 30 through the buckle using a relatively small amount of force. In one embodiment, the drive actuator 60 is pivotally connected to the strap portion 130 (i.e. buckle body) about a first axis 106 with pins 110, 111. The drive actuator 60 may include one or more teeth 112 that engage with the strap teeth 44 on the second side 35 of the strap in a ratcheting manner to drive and tighten the strap 30 as the actuator 60 is pivoted in the direction of arrow B (counterclockwise in FIG. 7) about a second axis 108 (i.e. drive actuator axis). In one illustrative embodiment, the teeth 112 are positioned on a wheel 200. The drive actuator 60 includes a lever 62 and the drive actuator 60 is biased in a direction toward the strap portion 130 and pawl 56 (i.e. opposite the direction of arrow B), for example by a torsion spring 118. In particular, as illustrated in FIG. 7, the wheel 200 has a recess 150 configured to receive a lever arm 152 such that rotating the lever 62 rotates the wheel 200, and thus the teeth 112. In another embodiment, the wheel 200 and lever arm 152 may be integrally formed.

To tighten the strap 30, the user pivots the lever 62 upwardly which pivots the drive actuator 60 in the direction of arrow B about the drive actuator axis 108 (which may be defined by pin 113) until the leading tooth 114 engages a tooth 44 on the second side 35 of the strap 30 as shown in FIG. 7. The user then pivots the drive actuator 60 about the drive actuator axis 108 to engage each succeeding tooth 112 with a corresponding strap tooth 44 to drive the strap through the passageway 42. As the strap 30 is driven through the passageway 42, the pawl 56 is continuously biased against the first side 33 of the strap and engages with the strap teeth 34 to prevent the strap from being inadvertently released during the operation of the drive actuator 60. In this manner, the user can incrementally tighten the strap tension by pivoting the drive actuator 60 as many times as necessary. When the desired tension is achieved, the user releases the drive actuator 60 which is then biased to its latched position by the torsion spring 118.

As shown in the figures, the ratchet buckle 32 may further include a release actuator 58 configured to release the buckle 32 from the strap 30 by disengaging the pawl 56 from the strap 30. This provides the user with a convenient and easily operated release mechanism that is particularly suitable for use in a snowboard binding in which the binding straps are frequently released and secured during a day of riding.

Figure 8:
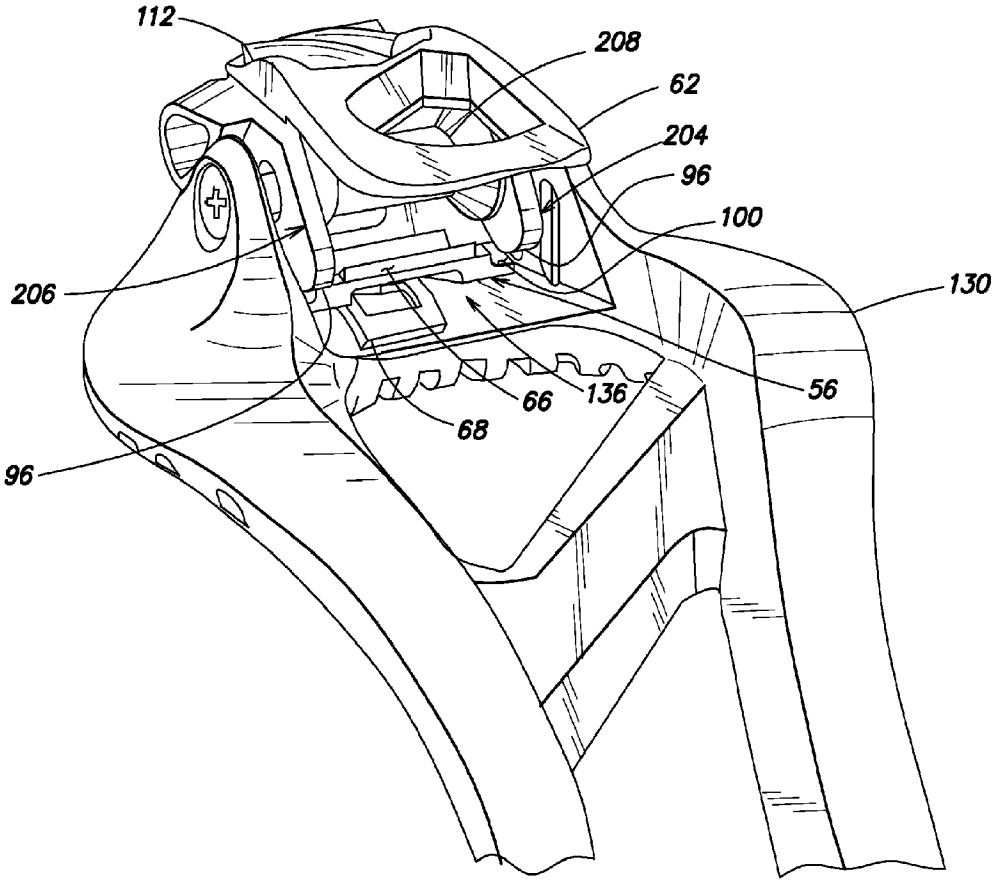
FIG. 8 is a perspective view of the ratchet buckle shown in FIG. 2 with portions removed.

In one embodiment as shown in FIGS. 4, 7 and 8, the release actuator 58 is pivotally mounted to the strap portion 130 about the first axis 106 (i.e. release actuator axis) by pins 110, 111, although other means of attachment known in the art may be used. As illustrated, the release actuator 58 includes a central member 208, two arms 204, 206 and release actuator lever 202 which are all coupled to the drive actuator 60. As shown in FIG. 8 (in which the strap 30 is omitted for simplification), the release actuator arms 204, 206 each include a lower cam surface 96 which is adapted to engage with the upper surface 100 of the pawl 56 to disengage the pawl from the strap 30. When the release actuator 58 is pivoted in the direction of arrow C (clockwise in FIG. 7), the cam surface 96 interacts with the pawl 56 to pivot the pawl 56 about the pivot axis 104 in the opposite direction of arrow A, thereby disengaging the pawl teeth 66 from the strap 30. In one embodiment, rotation of the release actuator lever 202 initiates movement of the release actuator arms 204, 206 to disengage the pawl 56 from the strap 30. In one embodiment, the release actuator arms 204, 206 each include a finger hold 210, 211 which a user can rotate to disengage the pawl 56.

It should be appreciated that although two release actuator arms 204, 206 are illustrated, each having a cam surface 96 which acts to disengage the pawl, the invention is not so limited. It is also contemplated that the release actuator 58 has only one cam surface 96, and more than two cam surfaces 96 are also contemplated. Furthermore, it should be appreciated that when there are two release actuator arms 204, 206, they may be spaced apart from each other by a distance at least as wide as the strap 30 such that the arms 204, 206 can extend down past the strap 30 on each side of the strap 30 to contact the pawl 56 at two spaced apart locations on opposite sides of the passageway 42.

As shown in FIG. 7, in one embodiment, the pawl 56 is pivotable about the pawl axis 104 and the drive actuator 60 is pivotable about the drive actuator axis 108, where the pawl axis 104 is located below the passageway (i.e. near a first side of the strap 30) and the drive actuator axis 108 is located above the passageway (i.e. near a second opposite side of the strap). In one illustrative embodiment, the release actuator 58 is pivotable about the release actuator axis 106, and the release actuator axis 106 may also be located above the passageway (i.e. near a second side of the strap and on the side of the passageway opposite the pawl axis 104).

As mentioned above, the drive actuator 60 may include one or more teeth 112 that engage with strap teeth 44 on the second side 35 of the strap to drive and tighten the strap 30. In one illustrative embodiment, the teeth 112 extend in a substantially helical configuration. In particular, the drive actuator 60 may include a plurality of teeth 112 which extend in a substantially helical configuration around at least a portion of the wheel 200. Applicant recognized that the use of helically configured teeth 112 may be desired as it enables a greater number of teeth 112 to be engaged with the strap 30 at one time. For example, in one embodiment, up to three teeth 112 may be configured to simultaneously engage with the teeth 44 on the second side of the strap 30. This may increase the performance and durability of the drive actuator 60 by enabling the drive actuator to mesh more smoothly with the strap 30. In one embodiment, the substantially helical teeth 112 are angled at approximately 30 degrees and the pitch is approximately 3 mm. It should be recognized that in another embodiment, non-helical teeth are also contemplated on the wheel 200.

Figure 5:
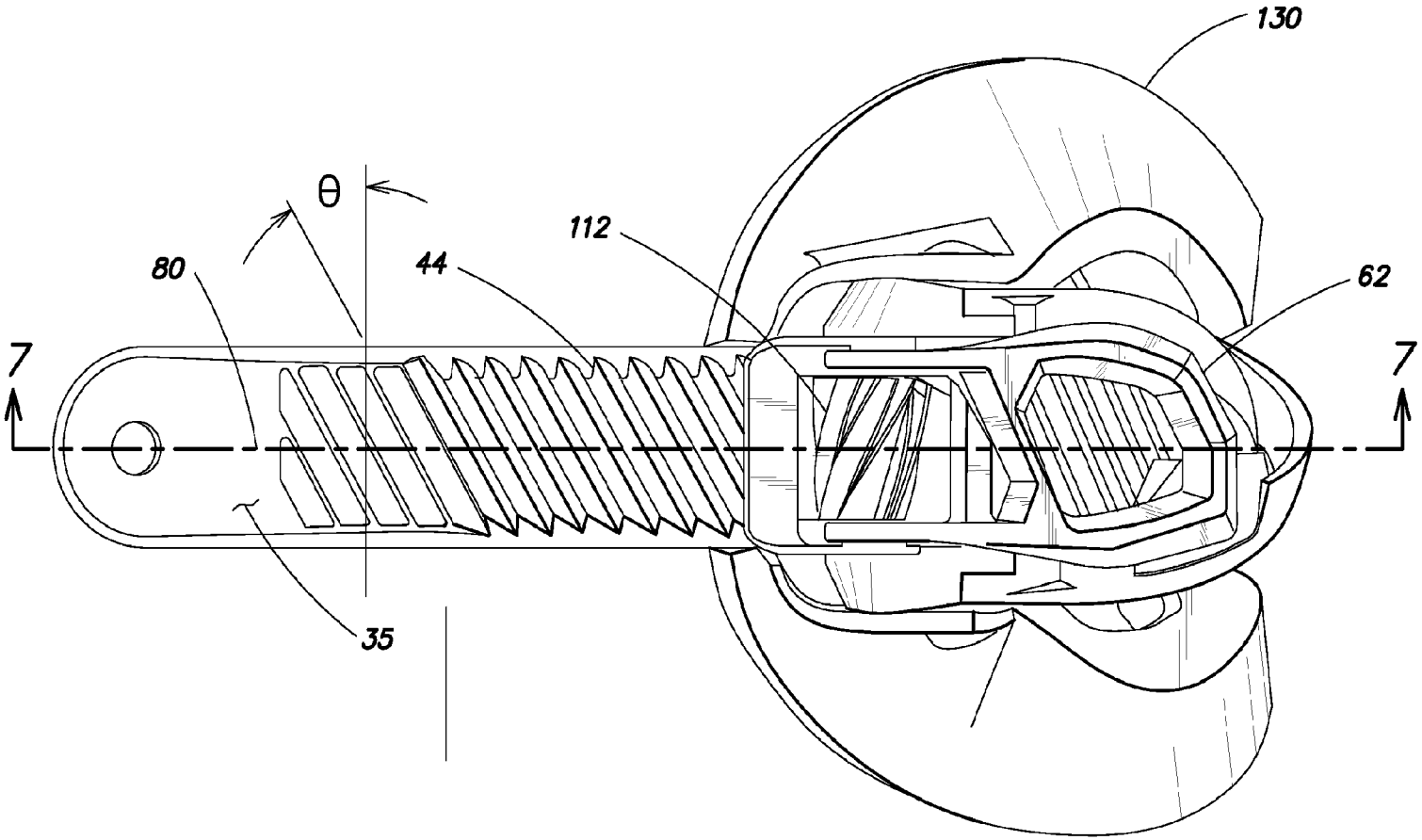
FIG. 5 is a top view of the ratchet buckle and strap assembly shown in FIG. 2.
Figure 6:
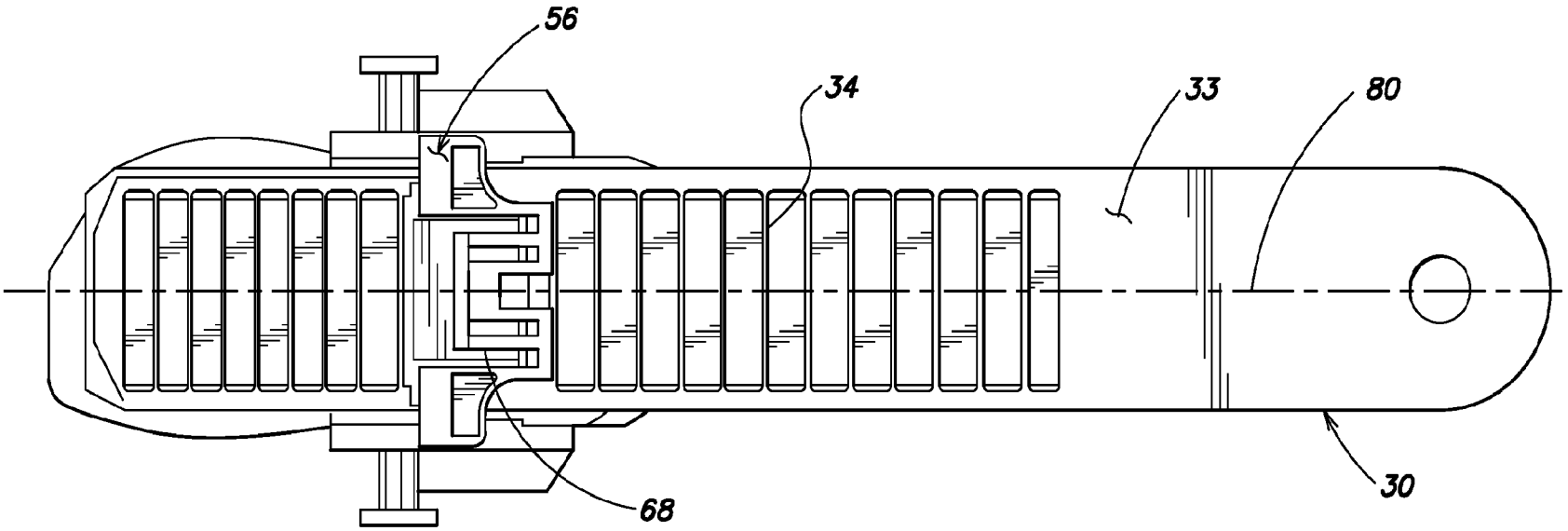
FIG. 6 is a bottom view of the ratchet buckle and strap assembly shown in FIG. 2 with portions of the buckle removed.

Aspects of the present invention are directed to a ratchet buckle 32 and strap 30 assembly where the strap has a plurality of first teeth 34 and a plurality of separate second teeth 44. In one embodiment, the orientation of the first teeth 34 is different from the orientation of the second teeth 44. In particular, as shown in FIGS. 5 and 6, the teeth 34, 44 are arranged differently. The plurality of first teeth 34 are arranged in a first orientation relative to a longitudinal axis 80 of the strap 30 such that the teeth 34 are substantially perpendicular to the longitudinal axis 80 (see FIG. 6). In contrast, the plurality of second teeth 44 are arranged in a second orientation such that the teeth 44 are not substantially perpendicular to the longitudinal axis 80 of the strap (see FIG. 5). As shown in the embodiment illustrated in FIG. 5, an angle θ defining the second orientation of the plurality of second teeth 44 relative to the first orientation of the plurality of first teeth 34 is at least approximately 30 degrees. It should be appreciated that in another embodiment, the angle θ is at least approximately 45 degrees, and in another embodiment, the angle θ is at least approximately 60 degrees.

It is also contemplated that in another embodiment, the orientation of the first teeth 34 is substantially the same as the orientation of the second teeth 44. For example, in one embodiment, the first teeth are substantially parallel to the second teeth such that the angle θ is approximately 0 degrees.

As shown in the figures, in one embodiment, the plurality of first teeth 34 are located on a first side 33 of the strap and the plurality of second teeth 44 are located on a second side 35 of the strap. In another embodiment, the first and second teeth 34, 44 may be located on the same side of the strap. For example, it is contemplated that the plurality of first teeth 34 may be spaced apart from and located on the same side of the strap as the plurality of second teeth.

As shown in FIG. 6, in one illustrative embodiment, the plurality of first teeth 34 on the first side 33 of the strap extend substantially across the width of the strap 30 and the teeth 34 extend across a majority of the length of the strap 30. However, it should be recognized that in another embodiment, the first teeth 34 may extend across a smaller portion of the width and/or a smaller or greater length of the strap.

Furthermore, as shown in FIG. 5, in one illustrative embodiment, the plurality of second teeth 44 on the second side 35 of the strap also extend substantially across the width of the strap 30 and the teeth 44 extend across a majority of the length of the strap 30. However, it should be recognized that in another embodiment, the second teeth 44 may extend across a smaller portion of the width and/or a smaller or greater length of the strap 30.

As shown in FIG. 6, the plurality of first teeth 34 extend in a substantially linear configuration across the width of the strap. As shown in FIG. 5, the plurality of second teeth 44 also extend in a substantially linear configuration across the width of the strap. In another embodiment, non-linear teeth configurations on the first and or second sides 33, 35 of the strap are also contemplated. For example, the teeth 34, 44 may be angled or curved as would be apparent to one of ordinary skill in the art. In one embodiment, the teeth on the strap 30 may be configured to engage with helical teeth. For example, as mentioned above, the drive actuator 60 may include one or more teeth having a substantially helical configuration. In this respect, the teeth on one or both sides of the strap 30 may be configured to engage with the helical teeth.

In one embodiment, the plurality of first teeth 34 may be sized and/or shaped differently than the plurality of second teeth 44. For example, in one embodiment, the teeth 44 on the second side 35 of the strap 30 may be larger and/or their pitch may be larger than the first teeth 34 on the first side 33 of the strap. In this respect, the strap teeth 44 which interact with the drive actuator 60 may be configured to be more robust to withstand the wear and tear which may be associated with the drive actuator. In contrast, the strap teeth 34 which interact with the pawl 56 may be smaller to enable finer adjustment of the strap 30. In another embodiment, the teeth 34, 44 may be substantially the same size and shape.

As mentioned above, in one embodiment illustrated in FIGS. 13-14, the ratchet buckle 332 may have a separate ratchet buckle body 300 which defines a strap passageway 42. This embodiment is similar to the embodiment described above and shown in FIGS. 1-12, except that a separate housing 300 defines the passageway (instead of the strap portion 130 defining the passageway). Otherwise, this ratchet buckle 332 operates in a similar fashion. A strap 30 (not shown) is inserted into the front portion 52 of the passageway 42 and exits through the rear portion 54 of the passageway. As shown, the ratchet buckle 332 includes a pawl 56 which engages the strap and prevents the strap from backing out of the passageway. In this embodiment, the pawl 56 is positioned within a cavity 136 in the buckle housing 300 and the pawl 56 is pivotally coupled to the buckle housing 300 via a rivet or pin 111. The ratchet buckle 332 also includes a drive actuator 60 which allows the user to incrementally drive the strap 30 through the buckle 332 to selectively tighten the strap, and a release actuator 58 configured to release the buckle 332 from the strap by disengaging the pawl 56 from the strap. The ratchet buckle housing 300 may be coupled to a strap portion 130, or it may be coupled directly to the binding base plate 41 and the strap portion 130 may be omitted.

In one illustrative embodiment, the strap portion 130 (i.e. buckle body) is formed of multiple components. As shown in FIGS. 3-4, the strap portion 130 may include a strap base 134 and a strap spine 132. The strap spine 132 may be more rigid and may be formed of thermoplastic polyurethane (TPU) and/or nylon. The strap spine 132 may act as the body or base of the ratchet buckle 32. The strap base 134 may be more flexible and may, for example, be formed of foam and/or fabric. The strap base 134 may act to cushion the more rigid strap spine 132 from the user's foot. Although the strap portion 130 is shown made of multiple components, it should be recognized that other configurations, including a one-piece strap construction are also contemplated.

It should be recognized that the ratchet buckle 32 and the strap 30 assembly components may be constructed of durable materials that can withstand the repeated locking and unlocking of the strap 30 and buckle 32, including but not limited to various types of plastics and metal known to one of ordinary skill in the art.

From the foregoing description, it will be appreciated that the ratchet buckle of the present invention provides a convenient and easily operated buckle that is particularly suitable for a soft boot snowboard binding which requires a user to release and secure the binding numerous times during a typical day of snowboarding. When the user wishes to secure a boot to a binding, the user steps into the binding and inserts the strap through buckle. Typically, the user may make coarse adjustments to the binding simply by pushing or pulling the strap further in the buckle. The binding strap is then selectively tightened by incrementally feeding the strap through the buckle using the drive actuator in a ratcheting manner. It will be appreciated that as the strap is tightened, the amount of force necessary to increase the tension in the strap also increases which may be easily overcome using the drive actuator lever. When the user wishes to release the buckle from the strap so that he or she can step out of the binding, the user simply moves the release actuator to release the pawl from the strap and pulls the buckle along the strap to separate the buckle from the strap. The tightening and release operations can be easily accomplished by a user wearing gloves and other hand coverings which are typically worn while snowboarding.

Although the ratchet buckle has been described in connection with a snowboard binding, as mentioned above, it is to be appreciated that the ratchet buckle of the present invention may also be incorporated into other foot or boot binding systems, such as snowboard boots, ski boots, in-line skates and the like, to provide the wearer of such footwear the convenience and advantages of incrementally tightening and easily loosening the footwear. The ratchet buckle may also be used in conjunction with a strap for binding or lashing down loads, such as securing a load to a vehicle roof and the like.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A ratchet buckle and strap assembly comprising:
a strap; and
a ratchet buckle, the ratchet buckle comprising:
a passageway configured to slidably receive the strap, the passageway having a front portion and a rear portion;
a pawl constructed and arranged to engage the strap and prevent movement of the strap in a direction from the rear portion toward the front portion, while allowing movement of the strap in a direction from the front portion toward the rear portion of the passageway, the pawl being positioned below the passageway; and
a drive actuator constructed and arranged to engage the strap and feed the strap through the passageway from the front portion toward the rear portion of the passageway, the drive actuator being positioned above the passageway;
wherein the strap has a plurality of first teeth on a first side configured to coact with the pawl, and a plurality of separate second teeth on a second side opposite the first side configured to coact with the drive actuator.

2. The ratchet buckle and strap assembly of claim 1, wherein the plurality of first teeth are arranged in a first orientation relative to a longitudinal axis of the strap, and the plurality of second teeth are arranged in a second orientation relative to the longitudinal axis of the strap, wherein the second orientation is different than the first orientation.

3. The ratchet buckle and strap assembly of claim 2, wherein the plurality of first teeth are substantially perpendicular to the longitudinal axis.

4. The ratchet buckle and strap assembly of claim 2, wherein the plurality of second teeth are not substantially perpendicular to the longitudinal axis.

5. The ratchet buckle and strap assembly of claim 2, wherein an angle defining the second orientation of the plurality of second teeth relative to the first orientation of the plurality of first teeth is at least approximately 30 degrees.

6. The ratchet buckle and strap assembly of claim 1, wherein the drive actuator includes teeth positioned on a wheel, and a lever engaged with the wheel such that movement of the lever rotates the teeth, the teeth being arranged to engage with the plurality of second teeth located on the second side of the strap, opposite the first side of the strap.

7. The ratchet buckle and strap assembly of claim 6, wherein the plurality of first teeth extend across a majority of a length of the strap.

8. The ratchet buckle and strap assembly of claim 6, wherein the plurality of second teeth extend across a majority of a length of the strap.

9. The ratchet buckle and strap assembly of claim 1, further comprising a release actuator pivotable about a release actuator axis located above the passageway, wherein the release actuator is actuable to disengage the pawl from the first side of the strap.

10. The ratchet buckle and strap assembly of claim 1, wherein the plurality of first teeth extend substantially across a width of the strap.

11. The ratchet buckle and strap assembly of claim 1, wherein the plurality of second teeth extend substantially across a width of the strap.

12. The ratchet buckle and strap assembly of claim 1, wherein the plurality of first teeth extend in a substantially linear configuration.

13. The ratchet buckle and strap assembly of claim 1, wherein the plurality of second teeth extend in a substantially linear configuration.

14. The ratchet buckle and strap assembly of claim 1, wherein the pawl includes a living hinge biasing the pawl towards the strap.

15. The ratchet buckle and strap assembly of claim 1, incorporated into at least one strap of a foot or boot binding system.

16. The ratchet buckle and strap assembly of claim 15, wherein the foot or boot binding system is a snowboard boot binding system.

17. A ratchet buckle and strap assembly comprising:
a strap; and
a ratchet buckle, the ratchet buckle comprising:
a passageway configured to slidably receive the strap, the passageway having a front portion and a rear portion;
a pawl constructed and arranged to engage the strap and prevent movement of the strap in a direction from the rear portion toward the front portion, while allowing movement of the strap in a direction from the front portion toward the rear portion of the passageway; and
a drive actuator constructed and arranged to engage the strap and feed the strap through the passageway from the front portion toward the rear portion of the passageway;
wherein the strap has a plurality of first teeth configured to coact with the pawl, and a plurality of separate second teeth configured to coact with the drive actuator wherein the drive actuator is pivotable about a drive actuator axis, and wherein the pawl axis is located below the passageway and the drive actuator axis is located above the passageway.

18. A ratchet buckle and strap assembly comprising:
a strap; and
a ratchet buckle, the ratchet buckle comprising:
a passageway configured to slidably receive the strap, the passageway having a front portion and a rear portion;
a pawl constructed and arranged to engage a first side of the strap and prevent movement of the strap in a direction from the rear portion toward the front portion, while allowing movement of the strap in a direction from the front portion toward the rear portion of the passageway, the pawl being positioned below the passageway; and
a drive actuator constructed and arranged to engage a second side of the strap opposite the first side and feed the strap through the passageway from the front portion toward the rear portion of the passageway, the drive actuator being positioned above the passageway.

19. The ratchet buckle and strap assembly of claim 18, wherein the ratchet buckle further comprises a buckle body, and wherein the pawl is pivotally mounted to the buckle body.

20. The ratchet buckle and strap assembly of claim 18, wherein the ratchet buckle further comprises a buckle body, and wherein the drive actuator is pivotally mounted to the buckle body.

21. The ratchet buckle and strap assembly of claim 18, wherein the ratchet buckle further comprises a buckle body formed by a strap portion.

22. The ratchet buckle and strap assembly of claim 18, wherein the pawl includes at least one pawl tooth configured to engage the first side of the strap to prevent the strap from being withdrawn from the passageway.

23. The ratchet buckle and strap assembly of claim 22, wherein the at least one pawl tooth is substantially perpendicular to a longitudinal axis of the passageway.

24. The ratchet buckle and strap assembly of claim 22, wherein the at least one pawl tooth extends in a substantially linear configuration.

25. The ratchet buckle and strap assembly of claim 22, wherein the drive actuator includes at least one drive actuator tooth configured to engage the second side of the strap and drive the strap through the passageway to tighten the strap.

26. The ratchet buckle and strap assembly of claim 25, wherein the at least one pawl tooth has a first orientation and the at least one drive actuator tooth has a second orientation, wherein the second orientation is different than the first orientation.

27. The ratchet buckle and strap assembly of claim 25, wherein the at least one drive actuator tooth is not substantially perpendicular to a longitudinal axis of the passageway.

28. The ratchet buckle and strap assembly of claim 18, further comprising a release actuator constructed and arranged to be actuated to disengage the pawl from the first side of the strap.

29. The ratchet buckle and strap assembly of claim 28, wherein the release actuator is coupled to the drive actuator and includes at least one arm configured to contact the pawl.

30. The ratchet buckle and strap assembly of claim 29, wherein the at least one arm includes a first arm and a second arm, wherein the first and second arms are configured to contact the pawl at two spaced apart locations on opposite sides of the passageway.

31. The ratchet buckle and strap assembly of claim 28, wherein the pawl is pivotable about a pawl axis, and wherein the release actuator is pivotable about a release actuator axis, wherein the pawl axis is located below the passageway and the release actuator axis is located above the passageway.

32. The ratchet buckle and strap assembly of claim 18, wherein the first side of the strap has a plurality of first teeth arranged in a first orientation and configured to coact with the pawl, and the second side of the strap has a plurality of second teeth arranged in a second orientation and configured to coact with the drive actuator.

33. The ratchet buckle and strap assembly of claim 18, wherein the pawl includes a living hinge biasing the pawl towards the strap.

34. The ratchet buckle and strap assembly of claim 18, incorporated into at least one strap of a foot or boot binding system.

35. The ratchet buckle and strap assembly of claim 34, wherein the foot or boot binding system is a snowboard boot binding system.

36. A ratchet buckle and strap assembly comprising:

a strap; and a ratchet buckle, the ratchet buckle comprising:

a passageway configured to slidably receive the strap, the passageway having a front portion and a rear portion;

a pawl constructed and arranged to engage a first side of the strap and prevent movement of the strap in a direction from the rear portion toward the front portion, while allowing movement of the strap in a direction from the front portion toward the rear portion of the passageway, the pawl including at least one pawl tooth configured to engage the first side of the strap to prevent the strap from being withdrawn from the passageway; and a drive actuator constructed and arranged to engage a second side of the strap opposite the first side and feed the strap through the passageway from the front portion toward the rear portion of the passageway, the drive actuator including at least one drive actuator tooth configured to engage the second side of the strap and drive the strap through the passageway to tighten the strap, wherein the at least one drive actuator tooth extends in a substantially helical configuration.

37. A ratchet buckle and strap assembly comprising:

a strap; and a ratchet buckle, the ratchet buckle comprising:

a passageway configured to slidably receive the strap, the passageway having a front portion and a rear portion;

a pawl constructed and arranged to engage a first side of the strap and prevent movement of the strap in a direction from the rear portion toward the front portion, while allowing movement of the strap in a direction from the front portion toward the rear portion of the passageway; and a drive actuator constructed and arranged to engage a second side of the strap opposite the first side and feed the strap through the passageway from the front portion toward the rear portion of the passageway, wherein the pawl is pivotable about a pawl axis, the drive actuator is pivotable about a drive actuator axis, and the pawl axis is located below the passageway and the drive actuator axis is located above the passageway.

38. A ratchet buckle and strap assembly comprising:

a strap; and a ratchet buckle, the ratchet buckle comprising:

a passageway configured to slidably receive the strap, the passageway having a front portion and a rear portion;

a pawl constructed and arranged to engage a first side of the strap and prevent movement of the strap in a direction from the rear portion toward the front portion, while allowing movement of the strap in a direction from the front portion toward the rear portion of the passageway; and a release actuator constructed and arranged to be actuated to disengage the pawl from the first side of the strap;

wherein the pawl is pivotable about a pawl axis, and wherein the release actuator is pivotable about a release actuator axis, wherein the pawl axis is located below the passageway and the release actuator axis is located above the passageway.

39. The ratchet buckle and strap assembly of claim 38, wherein the release actuator includes at least one arm configured to contact the pawl.

40. The ratchet buckle and strap assembly of claim 39, wherein the at least one arm includes a first arm and a second arm, wherein the first and second arms are configured to contact the pawl at two spaced apart locations on opposite sides of the passageway.

41. The ratchet buckle and strap assembly of claim 38, wherein the ratchet buckle further comprises a buckle body, and wherein the pawl is pivotally mounted to the buckle body.

42. The ratchet buckle and strap assembly of claim 38, wherein the ratchet buckle further comprises a buckle body, and wherein the release actuator is pivotally mounted to the buckle body.

43. The ratchet buckle and strap assembly of claim 38, wherein the ratchet buckle further comprises a buckle body formed by a strap portion.

44. The ratchet buckle and strap assembly of claim 38, wherein the pawl includes at least one pawl tooth configured to engage the first side of the strap to prevent the strap from being withdrawn from the passageway.

45. The ratchet buckle and strap assembly of claim 38, further comprising a drive actuator constructed and arranged to engage a second side of the strap opposite the first side and feed the strap through the passageway from the front portion toward the rear portion of the passageway.

46. The ratchet buckle and strap assembly of claim 45, wherein the drive actuator includes at least one drive actuator tooth configured to engage the second side of the strap and drive the strap through the passageway to tighten the strap.

47. The ratchet buckle and strap assembly of claim 46, wherein the at least one drive actuator tooth extends in a substantially helical configuration.

* * * * *